US005355556A

United States Patent [19]

Lyon

[11] Patent Number: 5,355,556

[45] Date of Patent: Oct. 18, 1994

[54] ENCLOSURE HAVING REVERSIBLE DOOR AND HINGE THEREFOR

[75] Inventor: Ronald W. Lyon, Carmel, Ind.

[73] Assignee: Aircom Metal Products, Inc., Indianapolis, Ind.

[21] Appl. No.: 8,549

[22] Filed: Jan. 26, 1993

[51] Int. Cl.[5] ..... E05D 7/10

[52] U.S. Cl. ..... 16/266; 16/265; 16/231

[58] Field of Search ..... 16/265, 266, 231

[56] References Cited

U.S. PATENT DOCUMENTS

| | | | |
|---|---|---|---|
| 19,374 | 2/1858 | Mason | 16/231 |
| 84,630 | 12/1868 | Jenks | 16/265 |
| 158,987 | 1/1875 | Selden . | |
| 317,701 | 5/1885 | Aston . | |
| 743,279 | 11/1903 | Haycock | 16/265 |
| 925,910 | 6/1909 | Hoke . | |
| 4,603,452 | 8/1986 | Paciorek . | |

FOREIGN PATENT DOCUMENTS

| | | | |
|---|---|---|---|
| 204022 | 11/1908 | Fed. Rep. of Germany | 16/265 |
| 752 | of 1858 | United Kingdom | 16/231 |

*Primary Examiner*—Carmine Cuda

*Attorney, Agent, or Firm*—Pearne, Gordon, McCoy & Granger

[57] ABSTRACT

Hinges on the door have pairs of pins facing in opposite directions. One of each pair of pins is inserted in a socket of a hinge knuckle. The end of the pin bears against an interior surface of the knuckle. The pins can be connected by a post. A slot is provided in the knuckle for receiving the post. The door is reversed by removing the pin from the socket, inverting the door, and inserting the opposite pin in a knuckle on the opposite side of the opening. The enclosure or the door is provided with a flange or seal to engage the door when it is closed, thereby inhibiting movement of the door in the plane of the door. Thus, disengagement of the pintle from the socket is prevented.

20 Claims, 5 Drawing Sheets

Fig.3A
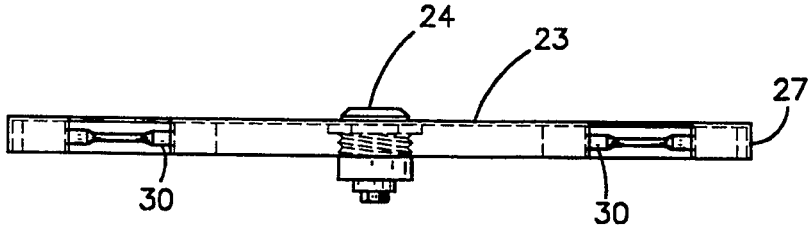
Fig.3B
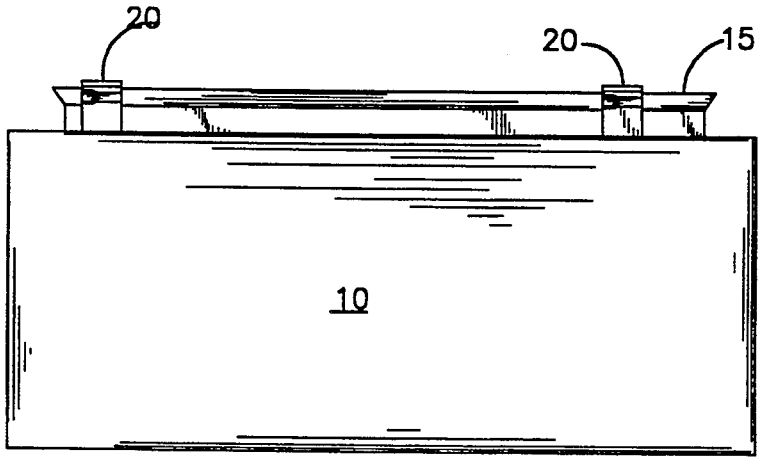
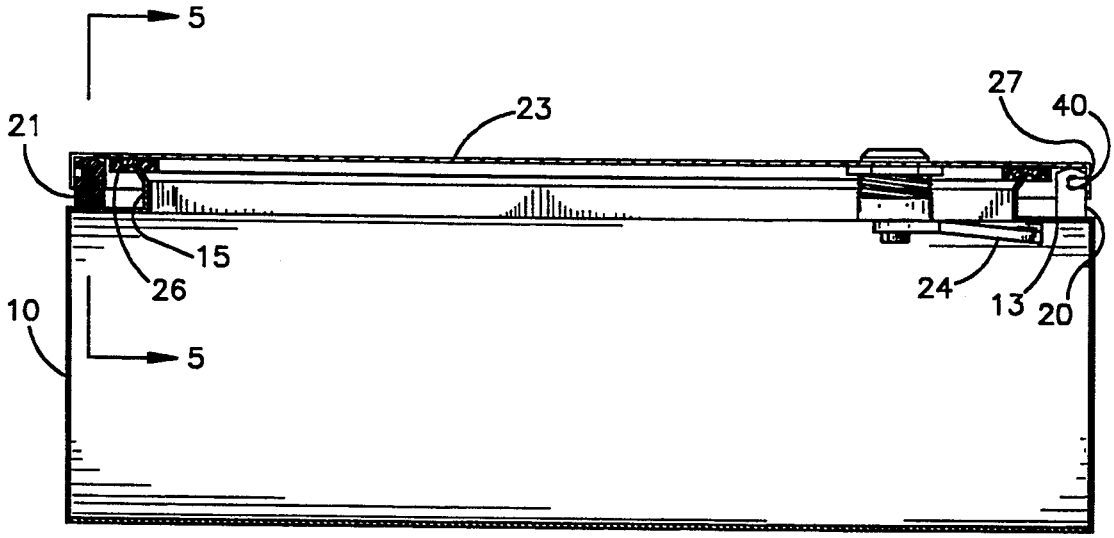
Fig.4

ENCLOSURE HAVING REVERSIBLE DOOR AND HINGE THEREFOR

BACKGROUND OF THE INVENTION

1. Field of the Invention

This invention relates generally to the field of doors and hinges and specifically to a hinge for a reversible enclosure door.

2. Description of the Related Art

Enclosures and access holes typically have swinging doors to close an opening. These doors are often mass produced and comprise a uniform assembly. Enclosures, for example, may be produced without any knowledge of the location where they will be installed. In some installations, it may be advantageous for the door to be hinged on the left side. In others, it may be advantageous for the door to be hinged on the right side. In addition, the circumstances or location of an enclosure may change so that it is desirable to reverse the door so that it is hinged on the opposite side from its original installation.

U.S. Pat. No. 925,910 to Hoke also shows reversible hinge. A first leaf has a cylindrical portion connecting two knuckles. An inclined outside edge of a knuckle on a second leaf bears on an inclined edge of one knuckle on the first leaf. The knuckle of the second leaf has a slot for receiving a flattened part of the cylindrical portion.

U.S. Pat. No. 158,987 to Selden shows a reversible hinge having pintles extending in opposite directions from an arm. One pintle is inserted into a socket so that the arm around the pintles bears against an outer surface around the socket.

U.S. Pat. No. 317,701 to Aston shows a reversible hinge wherein a removable barrel secures a first leaf to a pin on a second leaf. The first leaf has similar flanges on opposite sides, either of which can be secured to the barrel.

U.S. Pat. No. 4,603,452 to Paciorek shows a hinge wherein one set of knuckles is slotted. The slots receive flattened parts of a spring biased pin.

It is desirable to have an enclosure with a reversible door. The hinge for such a door should be easily assembled and disassembled without tools or other parts. Then when the door is closed the hinge should be secured to prevent inadvertant disassembly of the hinge and prevent the door from falling off of the opening.

SUMMARY OF THE INVENTION

The present invention provides a hinge having a first leaf with two axially opposed, axially spaced pintles generally round in cross-section and each having an end surface, and a second leaf having a knuckle with a socket generally round in cross-section for receiving one of the pintles, said socket having an internal surface upon which one of the pintle end surfaces bears.

The pintles are preferably cylindrical and the end surfaces are preferably circular or frusto-conical. The pintles can be connected by a preferably cylindrical post, in which case a slot is provided in the knuckle for receiving the post.

The present invention also provides an enclosure with a reversible door including a frame having an opening and having left and right sides and a door to close said opening. Two pairs of axially opposed, axially spaced pintles generally round in cross-section and each having an end surface are attached near an edge of the door and are substantially axially aligned. Four knuckles each having a socket generally round in cross-section for receiving one of the pintles, each of said sockets having an internal surface upon which one of the pintle ends can bear, two of the knuckles being axially aligned and mounted to the box on the left side of the opening and two of the knuckles being axially aligned are mounted to the box on the right side of the opening, so that two knuckles on the same side can each simultaneously receive one pintle of a corresponding pair.

The enclosure or door preferably has a flange or seal to engage the door when it is closed, thereby inhibiting movement of the door in the plane of the door. Thus, disengagement of the pintle from the socket is prevented. Engagement of the door with the enclosure permits the hinges to be used on an enclosure having a vertical or horizontal opening. In addition, the door can be used on an access hole to a compartment or other space.

The door is reversed by removing the pins from the sockets, inverting the door, and inserting the opposite pins in knuckles on the opposite side of the opening. In this way, a uniform door and enclosure can have either a left hand or right hand opening.

BRIEF DESCRIPTION OF THE DRAWINGS

FIG. 3A shows an end view of the door taken from line 3A—3A of FIG. 2;

FIG. 3B shows an end view of the door taken from line 3B—3B of FIG. 1;

FIG. 4 is a top view in section of the enclosure and door door taken along line 4—4 of FIG. 1;

DESCRIPTION OF THE PREFERRED EMBODIMENT

Figure 1:
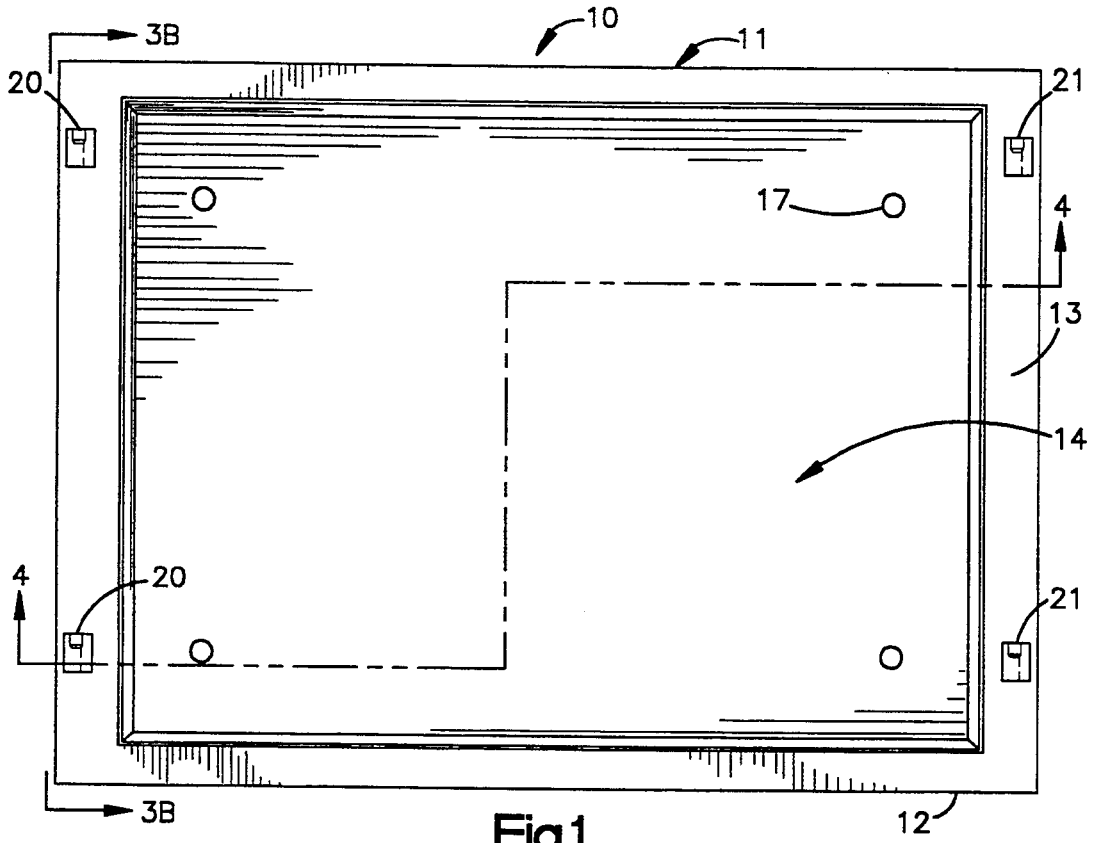
FIG. 1 shows a front elevational view of an enclosure according to the invention.

Referring to FIG. 1, an enclosure 10 having a top side 11 includes a frame 12 having a front surface 13. The enclosure can be an electrical box containing switch gear or fuses, for example. The front surface has an opening 14 therein. Preferably, the front surface has a flange 15 around the opening and projecting forwardly therefrom, as shown in FIG. 3B. Alternatively, the flange could be replaced by a recessed ledge within the opening. Means to mount the enclosure such as screw holes or bolts 17 are also provided. The enclosure has two left hinge knuckles 20 and two mirror-image right hinge knuckles 21 mounted on the front surface on either side of the opening.

Figure 2:
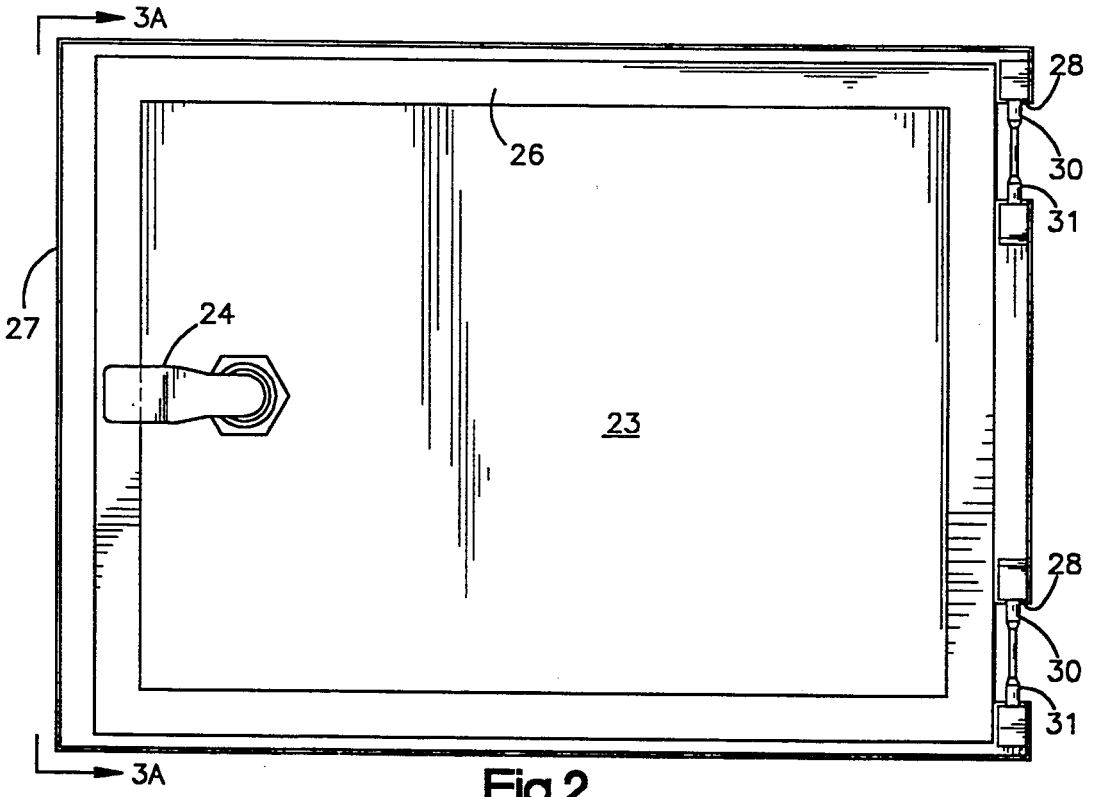
FIG. 2 shows a front elevational view of the rear side of a door according to the invention.

Referring to FIG. 2, a door 23 sized to close the opening 14 has a latch 24 positioned so that it can engage a rear face of the front surface 13 when the door 23 closes the opening 14. A foam gasket 26, or seal, is attached to the door to correspond with the enclosure flange 15. A flange 27 extends rearwardly from the outer edge of the door, as shown in FIG. 3A. Notches 28 can be provided on one side of the door. Two left hinge pintles 30 and two right hinge pintles 31 are mounted on the door, preferably within the notches 28. The pintles are axially aligned and pairs of the pintles extend in opposite directions.

FIG. 4 shows the door 23 in a closed position over the opening of the enclosure 10 with the latch 24 engaging the rear face of the front surface 13. The gasket 26 is pressed against the enclosure flange 15 to create a frictional engagement between the door and the enclosure.

Figure 5:
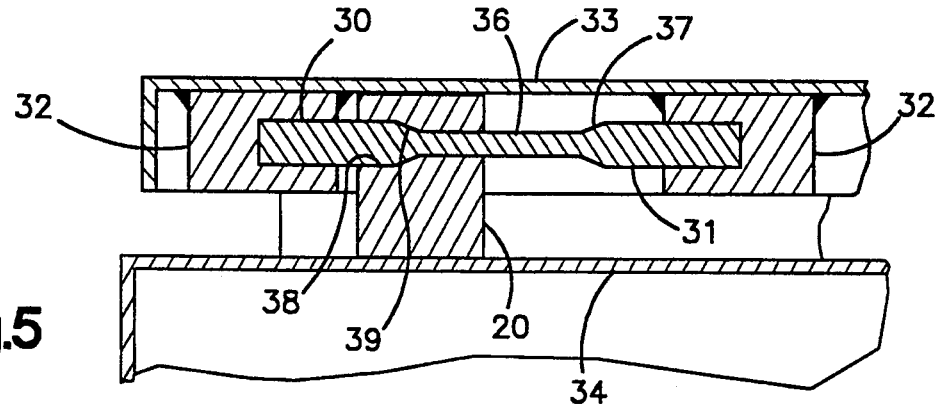
FIG. 5 shows an end view in section of an assembled hinge taken from 5—5 of FIG. 4.

Referring to FIG. 5, one of the left pintles 30 is shown installed in one of the left knuckles 20. A first leaf.33, in this case integral with the door, has the left and right pintles 30 and 31 mounted thereon with blocks 32. A second leaf 34, in this case integral with the enclosure, has the knuckle 20 mounted thereon. A third leaf corresponds with an opposite side of the enclosure from the second leaf 34 and has mounted thereon the right hinge knuckle 21. Preferably, the pintles are connected by a post 36, and each pintle has an end surface 37 which is frusto-conical in shape. The knuckle has a socket 38 with an internal surface 39 for receiving the pintle 31 and end surface 37. The internal surface 39 is frusto-conical to complement the end surface 37. A slot 40 is provided in the side of the knuckle, as shown also in FIGS. 4 and 6C, for receiving the post 36. The end surface 37 bears against the internal surface 39. The post 36 should be slightly smaller than the slot 40 and need not act as a bearing. The sides of the pintle 31 can bear against the socket 38 when a lateral force is applied. In this way, the pintle 31 acts as both a second knuckle and as a pintle. The block 32 which holds the pintle does not act as a bearing.

Figure 6A:
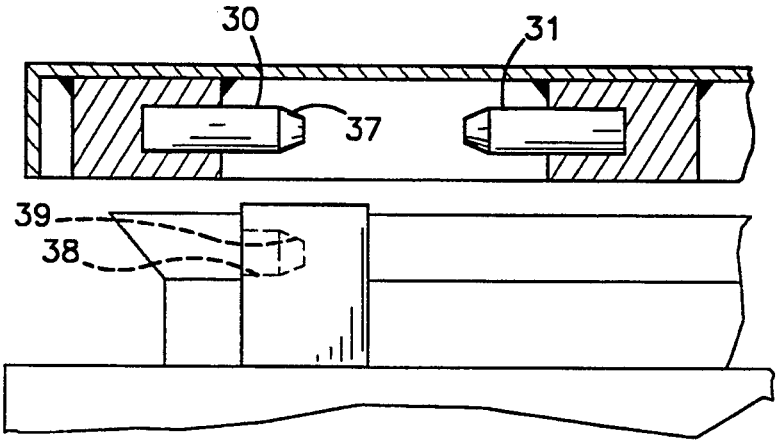
FIGS. 6A–C show end views of different embodiments of disassembled hinges according to the invention.
Figure 6B:
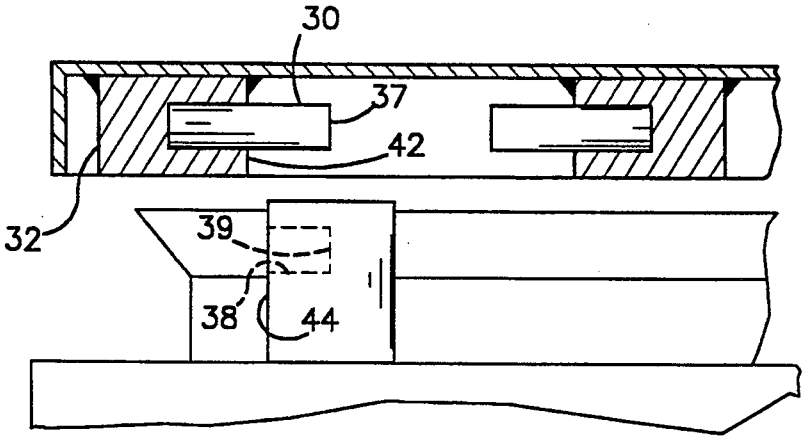
Figure 6C:
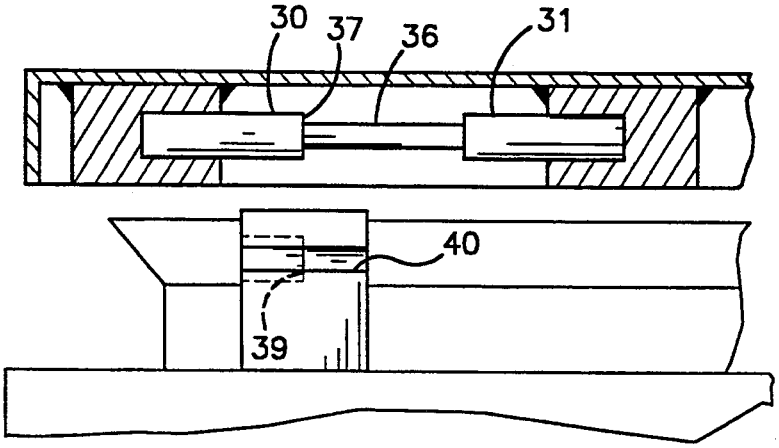

FIG. 6A shows an alternative embodiment of the hinge wherein the post is not used to connect the pintles 30 and 31, thus, the slot in the knuckle 20 is not necessary. FIG. 6B shows another hinge having a circular end surface 37 and circular internal surface 39. FIG. 6C shows another embodiment of a hinge having circular end surfaces 37 and a circular internal surface 39. The pintles 30 and 31 are connected by a post 36. The knuckle has a slot 40 for receiving the post.

Figure 7:
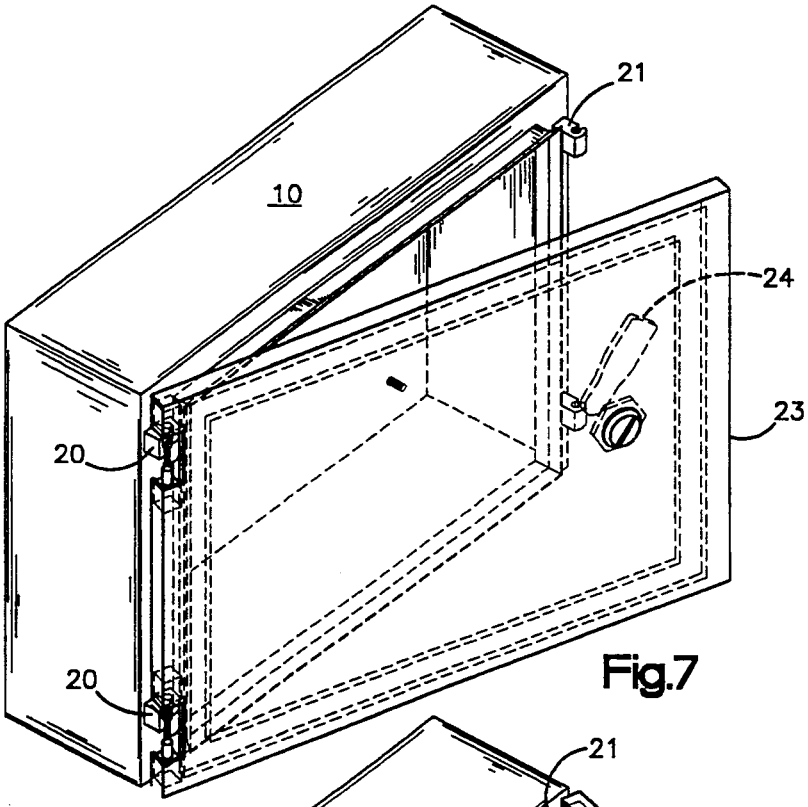
FIG. 7 is a perspective view of the enclosure with the door hinged on the left side; 9
Figure 8:
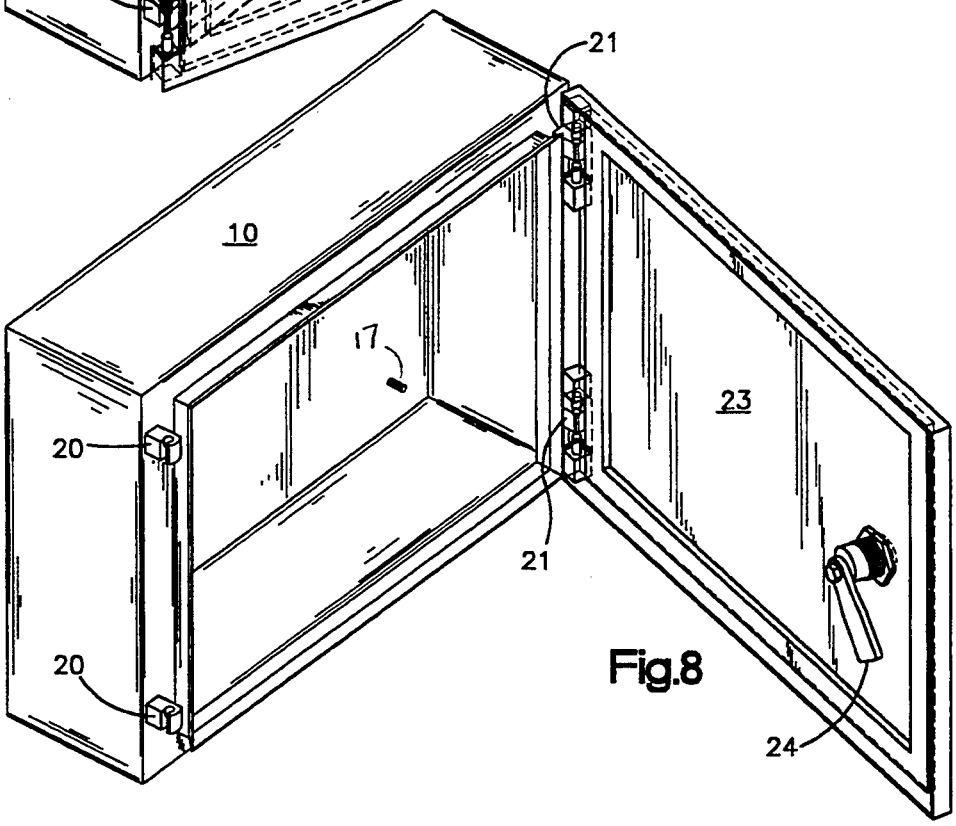
FIG. 8 is a perspective view of the enclosure with the door hinged on the right side.

As shown in FIGS. 7 and 8, the door 23 can be installed on the left hinge knuckles 20 so that the latch is on the right side of the enclosure. Alternatively, the door can be inverted and installed on the right hinge knuckles 21 so that the latch 24 is on the is on the left side of the enclosure. No tools or additional hardware are necessary. Further, it is not necessary to move or remove any parts from the enclosure except for the door.

When the door is closed and secured with the latch, the door engages the enclosure to prevent movement of the door in the plane of the door. This secures the pintle in the socket. In an alternative embodiment of the enclosure, the block 32 shown in FIG. 6B has a bearing surface 42 which bears against an external surface 44 of the knuckle. Again, the engagement of the door with the enclosure prevents disengagement of the pintle 37 from the socket 38.

Figure 9:
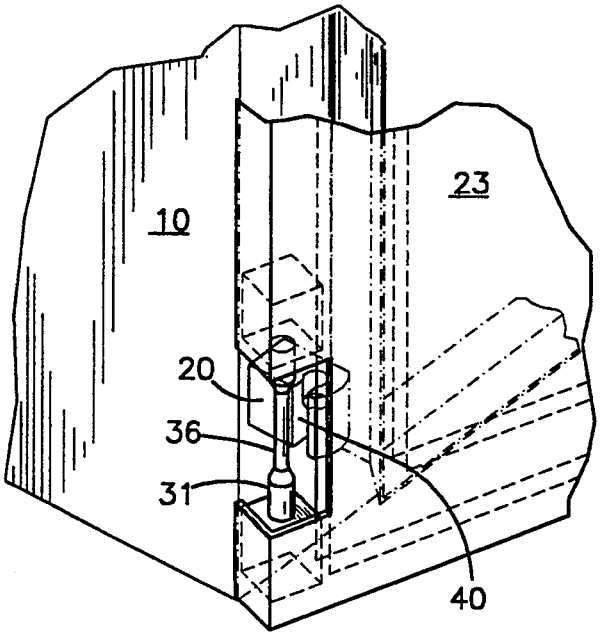
FIGS. 9–11 show the steps for assembling a hinge in a detail view in perspective.
Figure 10:
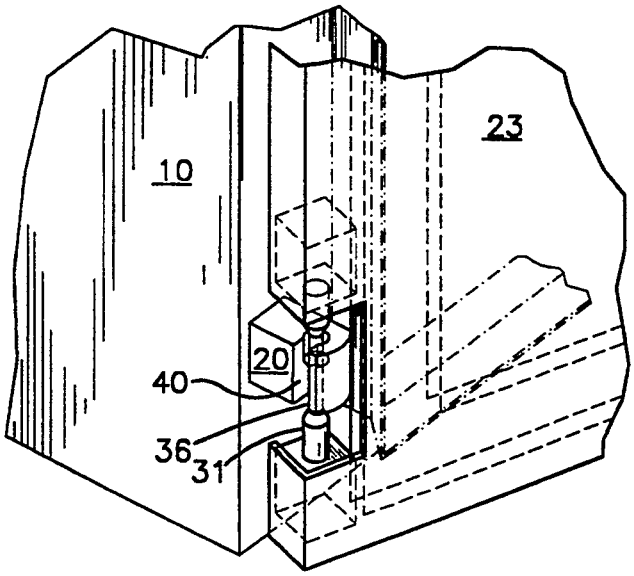
Figure 11:
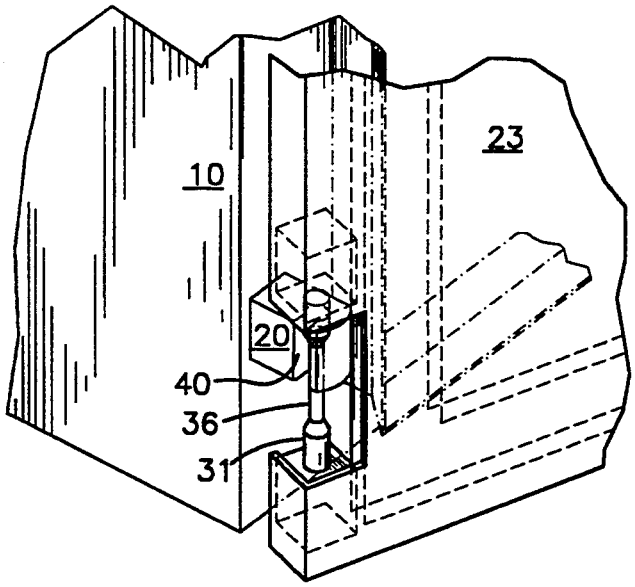

With reference to FIGS. 9–11, to assemble the door on the enclosure, the door is held so that the post 36 is near the slot 40 (FIG. 9). The post is inserted into the slot (FIG. 10), and the pintle is slid into the socket (FIG. 11). The gasket frictionally engages the enclosure flange. For removal or reversal, the door need be opened only enough to disengage it from the enclosure. The steps of FIGS. 9–11 are then reversed.

Alternatively, the door flange can engage the enclosure or the door can rest in the recessed ledge in the opening. When the door is closed, it engages the enclosure to prevent movement of the door which could engage the pintle from the socket. Thus, the hinge can be used on a door which closes an opening which is horizontal or at some other attitude. Further, the enclosure can be a room or any other space which is accessed through an opening closed by a door. If the hinges are located at the top and bottom of the opening, for example when the door hangs vertically, the slots 40 should open toward the same direction, as shown in FIG. 1, to prevent the hinges from slipping out when the door is opened.

The present disclosure describes several embodiments of the invention, however, the invention is not limited to these embodiments. Other variations are contemplated to be within the spirit and scope of the invention and appended claims.

What is claimed is:

1. A hinge, comprising:

a first leaf having two axially opposed, axially spaced pintles generally round in cross-section and each having an end surface;

a second leaf having a knuckle with a socket generally round in cross-section for receiving one of the pintles, said socket having an internal surface upon which one of the pintle end surfaces bears;

a post joining the pintle end surfaces, said post having a smaller cross-section than the pintles; and a slot in the knuckle for receiving the post.

2. A hinge according to claim 1, further comprising a third leaf having a mirror-image knuckle for alternatively receiving an end surface of the other pintle.

3. A hinge according to claim 2, wherein the sockets of the knuckles of the second and third leaves open in the same direction.

4. A hinge according to claim 1, wherein the pintle and socket end surfaces are frusto-conical.

5. A hinge according to claim 1, wherein the post is cylindrical.

6. An enclosure with a reversible door, comprising:

a frame having an opening and having left and right sides;

a door to close said opening;

two pairs of axially opposed, axially spaced pintles generally round in cross-section and each having an end surface, said pintles being attached near an edge of the door and being substantially axially aligned;

a post joining the pintle end surfaces, said post having a smaller cross-section than the pintles;

four knuckles each having a socket generally round in cross-section for receiving one of the pintles, each of said sockets having an internal surface upon which one of the pintle end surfaces can bear, two of the knuckles being axially aligned and mounted to the frame on the left side of the opening and two of the knuckles being axially aligned and mounted to the frame on the right side of the opening, so that two knuckles on the same side can each simultaneously receive one pintle of a corresponding pair; and a slot in the knuckle for receiving the post.

7. An enclosure according to claim 6, wherein the sockets open upwardly relative to the front opening.

8. An enclosure according to claim 6, wherein the sockets of the knuckles open in the same direction.

9. An enclosure according to claim 6, wherein the pintle end surfaces and socket internal surfaces are frusto-conical.

10. An enclosure according to claim 6, wherein the post is cylindrical.

11. An enclosure according to claim 6, wherein the slots open outwardly from the opening.

12. An enclosure according to claim 6, wherein the slots open toward the same direction.

13. An enclosure according to claim 6, further comprising a latch on the door which engages the frame.

14. An enclosure according to claim 13, wherein the latch is near the opposite edge from the pintles.

15. An enclosure according to claim 6, further comprising a forwardly extending flange around the opening.

16. An enclosure according to claim 15, wherein the door presses against the flange when it is closed over the opening.

17. An enclosure according to claim 16, wherein friction between the door and flange prevents movement of the door in the plane of the door, thereby locking the pintles in the sockets.

18. An enclosure according to claim 17, further comprising a resilient seal to increase the friction.

19. An enclosure according to claim 6, wherein the door engages the frame when it is closed over the opening to prevent movement of the door in the plane of the door, thereby locking the pintles in the sockets.

20. An enclosure according to claim 19, wherein the door is frictionally engaged with the frame.

* * * * *